United States Patent [19]

Schenkel

[11] 4,408,731

[45] Oct. 11, 1983

[54] CREEL FOR A SPINNING MACHINE

[75] Inventor: Eduard Schenkel, Seuzach, Switzerland

[73] Assignee: Rieter Machine Works Limited, Winterthur, Switzerland

[21] Appl. No.: 388,096

[22] Filed: Jun. 14, 1982

[30] Foreign Application Priority Data

Jun. 24, 1981 [CH] Switzerland ..... 4167/81

[51] Int. Cl.[3] ..... B65H 49/02; D02H 1/00

[52] U.S. Cl. ..... 242/131; 242/157 R; 57/352

[58] Field of Search ..... 242/131, 131.1, 157 R; 57/58.36, 58.7, 58.72, 58.83, 281, 291, 127.5, 127.7, 352, 353

[56] References Cited

U.S. PATENT DOCUMENTS 3,552,693 1/1971 Scherf ..... 242/131
4,180,218 12/1979 Jacobs ..... 242/131
4,365,468 12/1982 Schellenberg et al. ..... 57/291

*Primary Examiner*—Leonard D. Christian
*Attorney, Agent, or Firm*—Werner W. Kleeman

[57] ABSTRACT

With the creel for a spinning machine according to the invention at least two rows of rotatably suspended roving bobbins, which extend essentially in parallelism with respect to one another, are adjacently lined-up. Normally in ring spinning machines there are employed for such creels roving deflecting rods which extend horizontally in the longitudinal direction of the ring spinning machine. The rovings extending from the roving bobbins to the drafting arrangements are guided around the deflecting rods for the purpose of guiding the rovings. If the deflecting rod is located behind the bobbins, then insertion of the rovings about the rods is extremely cumbersome, and additionally, there exists the danger of damaging the rovings. If the deflecting rod is located further towards the front, then exchange of the bobbins becomes tedious. These drawbacks are eliminated with the invention in that a row of substantially rod-shaped holders is arranged behind the front row of roving bobbins. One end of each of the holders is rigidly mounted, and the other end of each holder is provided with at least two guides for rovings. These rovings extend directly from the related roving bobbins by means of the guides to the drafting arrangements.

14 Claims, 5 Drawing Figures

FIG. 1
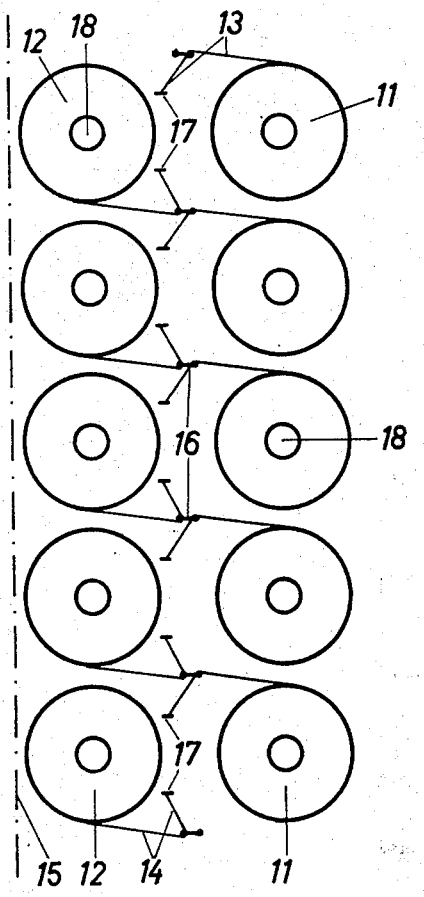
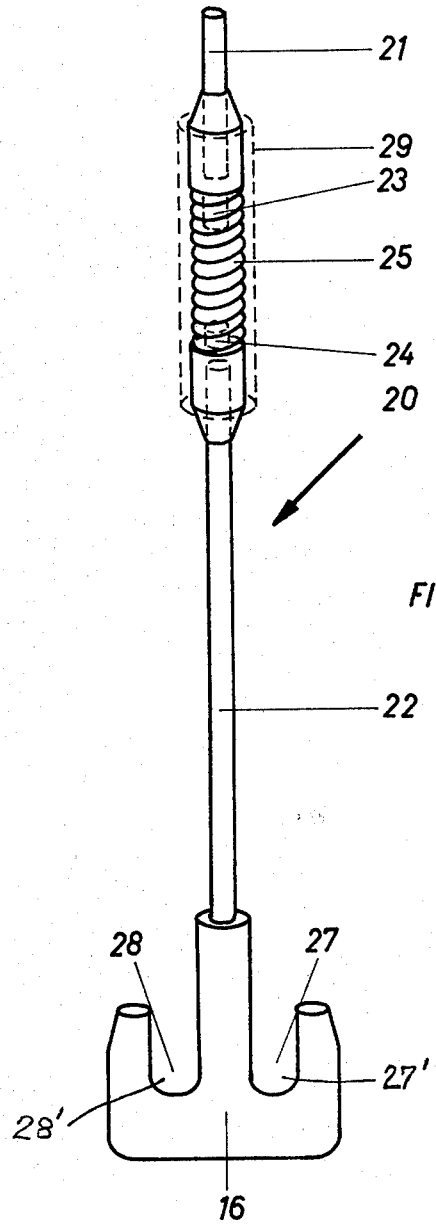
FIG. 3
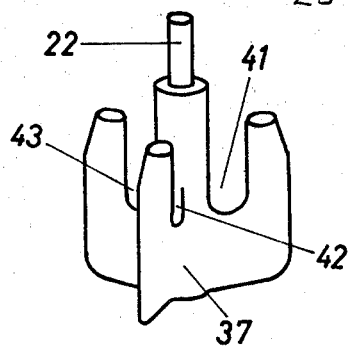
FIG. 4

CREEL FOR A SPINNING MACHINE

BACKGROUND OF THE INVENTION

The present invention relates to a new and improved creel for a spinning machine.

Generally speaking, the creel or creel arrangement for a spinning machine, as contemplated by the invention, is of the type wherein to each side of a center or central plane of the spinning machine and extending in the longitudinal direction of such machine, there are provided at least two rows of rotatably suspended roving bobbins. These two rows of roving bobbins extend essentially parallel to the center plane, are lined-up adjacent one another, and have laterally payed-off therefrom the related roving. Additionally, a row of drafting arrangements or drafting arrangement positions is provided substantially parallel to the center plane.

It is well known in practical applications in this field of technology that on ring spinning machines the rovings extending from the roving bobbins to the drafting arrangements are guided over roving deflecting or deflection rods arranged in the longitudinal or lengthwise direction of the ring spinning machine. In the case of creel arrangements composed of two or more rows of roving bobbins arranged behind one another, these deflecting rods originally were placed between the front row of bobbins and the second row of bobbins. However, this arrangement is afflicted with the disadvantage that exchange of the roving bobbins of the rear or back rows is extremely cumbersome, since the bobbins which are intended to be exchanged, in order to be removed or in order to bring them to their suspension devices, have to be placed in a substantially horizontal position and must be passed in such horizontal position beneath the deflecting rod. For donning the bobbins upon so-called Casablanca holders, the bobbin must be brought into its essentially upright vertical position behind the deflecting rod. The elevational position of the deflecting rod is more or less fixed or predetermined, because it is necessary to avoid the danger of damage to the roving unwound from the bobbins due to too high or too low a position of the deflecting rod. The adaptation of the elevational position of the deflecting rod therefore only can be carried out to a limited degree for the purpose of improving these conditions.

Further developments in this field have led to the creation of machines wherein the deflecting rods are placed behind the rearmost row of bobbins. Hence, the deflecting rods no longer get in the way of the bobbins which are to exchanged. On these machines the roving is guided from the bobbins towards the rear, around the deflecting rod and downwardly therefrom and then towards the front into the drafting arrangements. With this design, on the one hand, there is present a relatively large wrap angle of the roving about the related deflecting rod, and consequently, there is present a relatively high frictional resistance, so that there is present the danger of tearing or rupture or otherwise damaging the roving. A further drawback resides in the fact that the insertion of the roving around the deflecting rod, which is placed considerably towards the rear, is extremely difficult, particularly for operators who are not too tall. Finally, in an arrangement of the aforementioned type the roving delivered by the front bobbins must pass between the back or rear bobbins. During such time as the rear bobbins carry a full winding package there exists the danger that the roving passing therebetween might become stuck.

SUMMARY OF THE INVENTION

Therefore, with the foregoing in mind it is a primary object of the present invention to provide a new and improved connection of creel arrangement or creel for a spinning machine which is not afflicted with the aforementioned drawbacks and limitations of the prior art constructions.

Another and more specific object of the present invention is directed to a new and improved creel arrangement for a spinning machine which facilitates the doffing and donning of bobbins, affords effective and reliable guiding of the rovings from their bobbins to the drafting arrangements, and essentially eliminates the danger of damage to the rovings.

Still a further significant object of the present invention aims at the provision of a new and improved construction of creel for a spinning machine, which allows for effective and safe guiding of the rovings from their bobbins to the drafting arrangements, and which creel is relatively simple in construction and design, relatively economical to manufacture, extremely reliable in operation, not readily subject to breakdown or malfunction, and requires a minimum of maintenance and servicing.

Now in order to implement these and still further objects of the invention, which will become more readily apparent as the description proceeds, the creel for a spinning machine of the present development is of the type wherein a row of substantially rod-shaped holders is arranged parallel to the center plane to each side of such center plane. These holders are located behind the front row of bobbins. Furthermore, such rod-shaped holders are rigidly mounted at one of their ends, and at the other opposite end thereof each such holder is equipped with at least two guides for rovings, these rovings extending directly from the roving bobbins through the guides to the drafting arrangements.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic top plan view of a creel or creel arrangement for a spinning machine according to the invention;

FIG. 3 is a perspective view of one of the rod-shaped holders or holder members;

FIG. 4 is a perspective view of a further possible construction of a guide element.

DETAILED DESCRIPTION OF THE PREFERRED EMBODIMENTS

Figure 2:
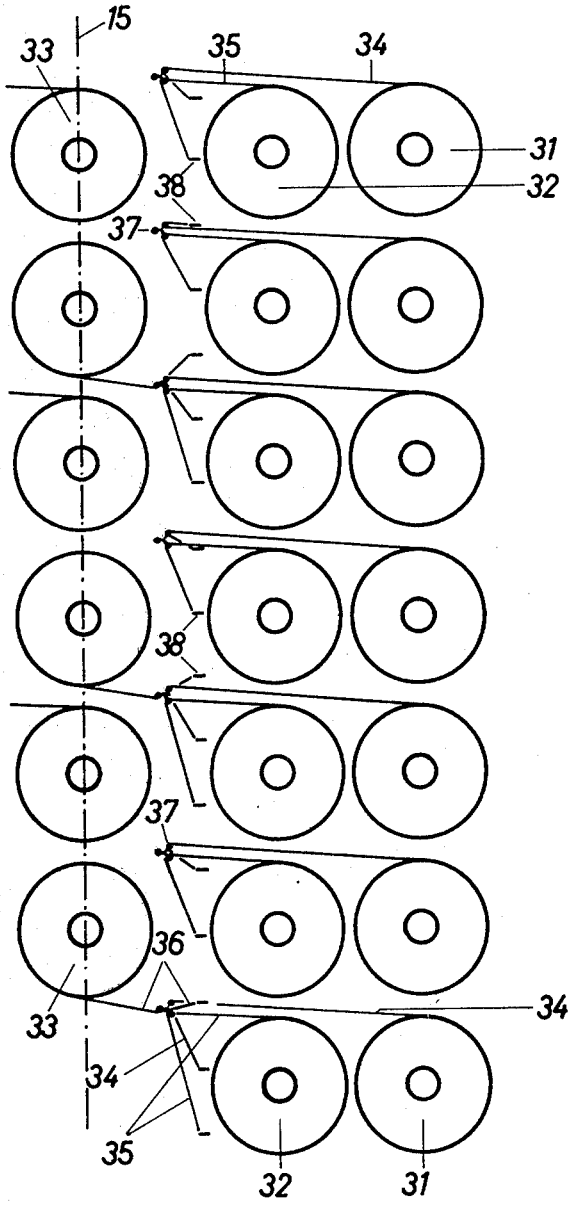
FIG. 2 is a view similar to that shown with regard to FIG. 1, depicting a somewhat different arrangement of the bobbins and holders.

Describing now the drawings, it is to be understood that only enough of the construction of the textile machine with which the creel arrangement of the present development can be used has been shown in the drawings in order to enable those skilled in this art to readily understand the underlying principles and concepts of the present development while simplifying the showing of the drawings. Turning attention now to FIG. 1, the creel arrangement shown therein contains a front or first row of bobbins 11 and a second row of bobbins 12. Upon the bobbins 11 and 12 there are wound the related rovings 13 and 14. The two rows of bobbins 11 and 12 are arranged to one side of a center or central plane 15 which extends perpendicular to the plane of the drawing of FIG. 1 and in the longitudinal or lengthwise direction of the spinning machine. This center plane 15 divides the creel arrangement into two substantially symmetrical halves. As a matter of convenience in the illustration, and since it will suffice for explaining the teaching and principles of the invention, only one half of the creel arrangement has been specifically depicted in the drawings. It is to be understood that in reality the bobbin rows 11 and 12 extend essentially parallel to the center plane 15 in both directions further than has in fact been depicted in the showing of FIG. 1. The rovings 13 and 14 are payed-off the roving bobbins 11 and 12, respectively, and extend over guide elements 16 carried by substantially rod-shaped holders or holder members, such as the holders 20 of FIG. 3 or the holders 50 of FIG. 5, to a related drafting arrangement or drafting arrangement position 17. Thereafter, there is accomplished between the drafting arrangements 17 and the not particularly illustrated rotating spindles the spinning of the rovings into yarn, as is well known to those skilled in this art.

The roving bobbins 11 and 12 are suspended in conventional manner from suitable holder pins, typically Casablanca holder pins or holders, and are freely rotatably about their lengthwise axes 18. The removal of the rovings 13 and 14 from the corresponding bobbins 11 and 12 is accomplished while rotating these bobbins about their lengthwise axes 18 which are disposed essentially perpendicular to the plane of the drawing. The Casablanca holder pins or holders, in turn, are supported on conventional bobbin support rails which have not here been further shown since such rail constructions are likewise well known and do not form part of the subject matter of the present development.

Turning attention now to FIG. 3 there has been depicted therein a substantially rod-shaped holder or holder member 20 which will be seen to comprise two rod portions or sections 21 and 22, each of which contains a threaded end section or region 23 and 24, respectively. A pre-tensioned helical spring 25 or equivalent structure is fixedly connected to the end sections 23 and 24. At the lower end of the rod portion 22 there is attached the related guide element 16. In the embodiment under discussion each such guide element 16 possesses two guides or guide facilities 27 and 28 for coverings. The holders 20 are mounted with their uppermost rod portion 21, which is shown in FIG. 3, at the spinning machine frame, for instance at a support rail, and, in the embodiment depicted, extend downwardly from their attachment location.

There is payed-off from each of the bobbins 11, during the rotation thereof, the roving 13 carried thereby and such roving 13 is then guided by means of one of the guides, such as for instance the guide 27 of the related guide element 16, to its corresponding drafting arrangement 17. In analogous fashion there is payed-off from each bobbin 12 its related roving 14 and such is then guided through the other guide 28 of the related guide element 16 to its related drafting arrangement 17.

If the bobbins 11 and 12 which are arranged behind one another or in tandem, viewed in a direction which is perpendicular to the center plane 15, are construed to constitute a group of bobbins, then a respective guide element 16 and its related holder or holder member 20 will be understood to be arranged between two neighboring bobbin groups, and specifically, between the front row of bobbins containing the bobbins 11 and the second or rear row of bobbins containing the bobbins 12. The roving 13 from a bobbin 11 and the roving 14 from a bobbin 12 of such group travel over or through the guides 27 and 28, respectively, of the related guide element 16 and its holder 20. Equally, it will be appreciated that the mentioned bobbins 11 and 12 which are arranged immediately behind one another belong to the same group which neighbor the corresponding holder or holder facility 20.

In the event that the roving 13 or 14, as the case may be, on the related bobbin 11 or 12 is spent or depleted, then it is apparent that such exhausted bobbin must be replaced by a new full bobbin 11 or 12, as the case may be. As far as the front bobbins 11 are concerned that does not constitute any significant problem or operating procedure. At the front row of bobbins 11 the empty bobbins are simply released from their suspension or support at the rotational bearing, removed and thereafter there is donned a new full bobbin in the suspension device.

The procedure becomes more complicated, however, when one of the bobbins 12 of the rear or back row is depleted. In order to exchange a bobbin 12 of the second bobbin now, it is necessary to initially remove the bobbin 11 which is positioned immediately forwardly thereof, in other words that bobbin of the front row of the same group. Thereafter, the exhausted bobbin 12 becomes accessible by reaching through the formed alley, can be released from its suspension and again withdrawn through such open alley between the two front bobbins 11, and then a new full bobbin 12 can be inserted through the alley and donned onto the corresponding suspension device. It should be apparent that these manipulations can be accomplished easier than if there were present, as in the prior art, the horizontal roving deflection or deflecting rod extending parallel to the center plane 15 at the location of the guide elements 16. The rod-shaped holders 20 located at the center or central region between the thereat neighboring bobbin groups permit passage of the full bobbins which are to be inserted between neighboring holders 20 while the bobbins are in their essentially upright vertical position. It is recommended, in particular, and as shown in FIG. 3, to use as the guide element 16 a guide element designed as a substantially flat body or body member in which there are formed, by means of the depicted recesses 27' and 28', the corresponding guides 27 and 28, respectively, and which is arranged essentially perpendicular to the center plane 15. In this manner there can be practically eliminated the presence or parts which protrude into the alley formed between the bobbin groups during the bobbin exchange operation.

If, under certain circumstances, the holders or holder members 20 still present an obstacle during the exchange of the bobbins 12, then it is a desirable aspect of the invention to design them so as to be deflectable or movable. A specific construction complying with this requirement is fulfilled by the holder construction of FIG. 3. The holder 20 thereof is equipped with a suitable flexible element, in the embodiment under discussion with the aforementioned helical spring 25, between the end portions 23 and 24. During the donning or doffing of a bobbin 12 it is therefore possible, by appropriately bending the spring 25, to laterally manually displace away, in any random direction, the rod portion or rod 22, so that it practically no longer constitutes an obstruction or hindrance during the bobbin exchange operation. Since the spring 25 is pre-biased or pre-tensioned, the rod portion 22, following its release, automatically moves or snaps back into its original starting or work position.

It should be readily apparent that the insertion of the rovings 13 and 14 through their related guides 27 and 28 can be accomplished with considerably greater ease than if the roving had to be inserted around a roving deflecting rod located at the site of the center plane 15. A particularly effortless insertion of the rovings 13 and 14 is possible if the guides 27 and 28, and specifically the recesses 27' and 28' forming the same, are of substantially U-shaped configuration, as depicted in FIG. 3. It is here to be considered that the bobbins 11 and 12 are suspended at a considerable elevational position, and that the bobbin space can extend far to the rear. Furthermore, when using, for instance, the guides 27 and 28 as shown in FIG. 3, there is obtained, in contrast to a deflection of the rovings about a rod, a cleaner and more effective guiding of such rovings because the latter are necessarily and positively held separated from one another.

In the exemplary embodiment depicted in FIG. 2 there is present a front row of bobbins 31 carrying rovings 34, and a second of bobbins 32 carrying the rovings 35. Additionally, there will be recognized a third row of bobbins 33 carrying the rovings 36 and located at the center of the machine, i.e. at the site of the center or central plane 15. A respective roving 34 and 35 extends from each of the related bobbins 31 and 32 belonging to a bobbin group and leads to a guide element 37, of the type depicted in FIG. 4, and from such guide element 37 then travels to the corresponding drafting arrangement 38. As to the bobbins 33 there extends from each second bobbin a roving 36 to a related one of the guide elements 37 and its corresponding drafting arrangement 38. From the other bobbins 33 the roving 36 is fed to the left-hand portion of the spinning machine, located to the left side of the center plane 15 of the arrangement of FIG. 2. This half of the creel is analogously designed to the part of the creel appearing at the right-hand side. Hence, there can extend three respective rovings to each second guide element 37 and to each intermediately dispositioned guide element 37 two respective rovings.

As already previously mentioned, an embodiment of guide element containing three guides 41, 42 and 43 has been disclosed in FIG. 4 with regard to the therein depicted guide element 37. This guide element 37 can be operatively connected to a suitable holder member, for instance a holder 20 of the type depicted in FIG. 3, wherein, as should be readily evident, the guide element 16 thereof is then simply replaced by the guide element 37 shown in FIG. 4. Both the construction of guide element 16 of FIG. 3 and that of the guide element 37 of FIG. 4, ensure for a clean separation of the rovings from one another, and by virtue of the substantially U-shaped configuration of their guides 27, 28 (FIG. 3) and 41, 42 and 43 (FIG. 4) there is afforded an easy insertion or threading-in of the related roving. The guides 41, 42 and 43 are distributed at essentially the same angular spacing from one another about the rod portion or rod 22 forming a center.

With the embodiment depicted in FIG. 2, during the bobbin exchange process of the bobbins 33 the latter must be introduced by means of an alley formed by two respective bobbins 31 and 32 of two bobbin groups. Therefore, these alleys are longer than the ones which are formed with the creel construction of the arrangement of FIG. 1 previously discussed. Thus, the exchange of the bobbins is comparatively more difficult and cumbersome, so that the provision of the holders constructed according to the teachings of the invention, in this case proves to be especially useful for the exchange of the bobbins 33. In particular, if the holders are constructed to be deflectable and can be manually moved towards the side, then there is realized an appreciable facilitation in the bobbin exchange work. In the exemplary embodiment depicted in FIG. 2, the holders and their guide elements are located between the second bobbin row containing the bobbins 32 and the third row of bobbins 33 extending along the center of the spinning machine. Consequently, the bobbins 31 of the front row and the bobbins 32 of the second forwardmost row can be exchanged without having to move past the holders. The holders therefore only need to be taken into account during the exchange of the bobbins 33. Even though with this exemplary arrangement the guide elements 37 are located relatively far towards the rear, nonetheless the insertion of the rovings into the guide elements 37 can be carried out quite easily because, instead of the need of placing or inserting the roving about a related rod, it is here necessary, according to the invention, to only insert the roving into its corresponding guide, and, in particular, if there is used the substantially U-shaped guide as shown in the drawings, then there is only required insertion of the roving from above into the recess forming such related guide.

Figure 5:
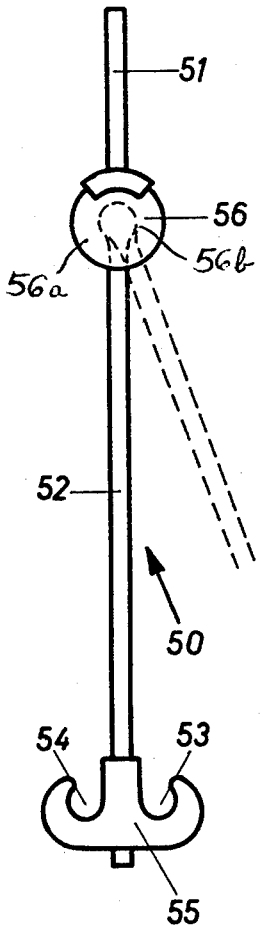
FIG. 5 is a view of a further embodiment of substantially rod-shaped holder or holder element.

Continuing, in FIG. 5 there has been depicted an exemplary embodiment of holder or holder member 50 which possesses two rod portions or sections 51 and 52. The rod portion 52 carries at its lower end a guide element 55 containing the guides 53 and 54, the shape of which conforms to a certain extent to an eyelet. The rod portion 51 is fixedly connected with a hinge or rotatable joint 56, whereas the rod portion 52 is pivotably connected at the hinge or pivot joint 56. This hinge or pivot joint 56 may comprise two oppositely situated pre-biased disks 56*a* between which there is positioned the rod portion 52. By providing appropriate furrows or recesses, merely generally indicated by reference character 56*b*, at the faces of the disks 56*a* which confront one another there can be defined two stable angular positions of the rod portions 51 and 52 with regard to one another. One of these positions is constituted by the illustrated extended arrangement of the rod portions 51 and 52 where they are essentially in alignment with one another. The other position is depicted by the phantom line showing, and specifically wherein the rod portion 51 remains in its original position, whereas the other rod portion 52 is angled towards the right of the showing of FIG. 5 into the broken line illustrated position thereof. The upper rod portion 51 is fixedly mounted to part of the machine frame.

The lower rod portion 52, prior to exchange of a bobbin, is tilted or moved towards the side into the broken line position, so that during the bobbin exchange operation it completely frees or clears the alley required during this time. After the bobbin exchange operation has been completed the rod portion 52 is then again tilted back into its essentially vertical position constituting the starting or work position.

By again reverting to FIG. 3, it is here additionally mentioned that in the illustrated exemplary embodiment the pitch or thread increments of the not particularly referenced threads of the threaded end portions 23 and 24 and the pitch of the spring 25 are essentially of the same magnitude. Under these circumstances the threaded end portions 23 and 24 can be threadably connected with the spring 25. Once they have been threadably interconnected these parts are fixedly and positively joined to one another, since when the spring is turned in the sense of releasing the thread connection the spring is tightened in its circumferential direction, i.e. in the direction of its coils or windings, in a manner such that it becomes fixedly clamped. This spring 25 thus is self-clamping. Consequently, no additional measures or facilities are required, such as for instance screws, for interconnecting the parts 23, 24 and 25. A steel spring constitutes an extremely durable, elastic or resilient member. Because of the unavoidable fly waste which is present during textile processing, it is recommended that the spring 25 be covered with a soft protective sheath or covering 29. The same also, of course, holds true for the pivot or hinge joint 56 depicted in the arrangement of FIG. 5.

The elastic member coupling the rod portions 21 and 22 also can be formed of rubber which, when possessing a hose-shaped design, can be pulled over the end portions or sections 23 and 24, or else can be mounted in bores provided in the end portions or sections 23 and 24 if the elastic member is provided in the form of a solid cylinder.

In the embodiment depicted in FIG. 5, the broken line tilted position of the rod portion 52 forms an obtuse angle with the downwardly depending rod portion 51. According to a further possible construction of the invention, in such tilted-out position of the rod portion 52 such can form, instead of the obtuse angle or in addition to such obtuse angle, also a right angle.

Additionally, the number of guides provided on a related holder can be chosen as desired, corresponding to the prevailing requirements and the encountered conditions at the creel arrangement.

A movement of the holders 20 and 50 as completely out of the way as possible is realized if, with the constructions depicted by way of example in FIGS. 3 and 5, the rod portions 21 and 51 are designed to be as short as possible. In most instances the rod portions 21 and 51 are constructed to be appreciably shorter in length than the rod portions 22 and 52, respectively.

In the embodiments under discussion it has been assumed that the holders 20 and 50 are mounted on a support rail provided for this purpose. However, there are also possible embodiments according to the invention, while practicing the underlying principles and teachings thereof, wherein the holders are mounted on a bobbin support rail, and the fixed rod portion is designated to be angled or flexed, or if the holder is designed to be straight such holder can be positioned at an inclination or obliquely in its working position.

While there are shown and described present preferred embodiments of the invention, it is to be distinctly understood that the invention is not limited thereto, but may be otherwise variously embodied and practiced within the scope of the following claims. Accordingly,

What I claim is:

1. A creel for a spinning machine having a center plane and a longitudinal direction of extent, comprising:

at least two rows of rotatably mounted roving bobbins located to each side of the center plane of the spinning machine;

each of said row of roving bobbins extending essentially parallel to the center plane;

each of the roving bobbins of a row being adjacently aligned with respect to one another and serving for paying-off roving therefrom and for infeeding the same to a related drafting arrangement;

at least one row of substantially rod-shaped holders arranged to each side of the center plane and extending essentially parallel to said center plane;

each said row or rod-shaped holders being located behind one of the rows of bobbins defining a front row;

said holders having opposed ends;

one of the ends of each of the holders being rigidly mounted;

the opposite end of each of said holders being equipped with means defining at least two guides for rovings; and said rovings extending directly from their roving bobbins by means of said guides to their related drafting arrangement.

2. The creel as defined in claim 1, wherein:

said at least two rows of roving bobbins to each side of the center plane define said front row of roving bobbins and a second row of roving bobbins;

the roving bobbins of both rows which are located behind one another and located in a direction extending at right angles to the center plane defining respective groups or roving bobbins; and said holders being arranged between said groups of roving bobbins.

3. The creel as defined in claim 2, wherein:

said holders are located between the front row of roving bobbins and the second row of roving bobbins;

each holder contains two of said guides;

a roving payed-off a roving bobbin of the front row of roving bobbins of a predetermined group of said group of roving bobbins neighboring said holder extending through one of said guides; and the roving payed-off the roving bobbin of the second row of another group of said roving bobbins neighboring said holder extending through the other guide of said holder.

4. The creel as defined in claim 1, further including:

a third row of roving bobbins arranged at the location of the center plane;

said rows of roving bobbins defining said front row, a second row, and a rear row;

said holders being arranged between the second row of roving bobbins and the third row of roving bobbins;

the rovings from the roving bobbins of the front row of roving bobbins and from the second row of roving bobbins of a predetermined group of said roving bobbins neighboring a predetermined holder extending through said guides of said predetermined holder; and at each second holder the roving from a roving bobbin of the third row of roving bobbins of another group of roving bobbins neighboring said holder extending through a third guide of said holder.

5. The creel as defined in claim 1, wherein:
said holders are capable of being supported on a bobbin support rail.
6. The creel as defined in claim 1, wherein:
each of said holders comprises two rod portions;
a movable element for interconnecting said two rod portions;
one of said rod portions being rigidly mounted at an end thereof; and
the other of said rod portions being deflectable out of a work position and work again into said work position by means of said movable element.
7. The creel as defined in claim 6, wherein:
said movable element comprises a body made from an elastic material; and
said body being connected with a respective end section of each of said rod portions.
8. The creel as defined in claim 7, wherein:
said body defines a pre-tensioned helical spring.
9. The creel as defined in claim 8, wherein:
oppositely situated end sections of said rod portions are each provided with threads;
said threads of said rod portions being threadably connected with said helical spring;
the pitch of the threads and the pitch of coils of the helical spring are essentially of the same magnitude; and
a protective sheath encasing said helical spring.
10. The creel as defined in claim 6, wherein:
said movable element comprises pivot joint means structured to define at least two stable angular positions for said rod portions.
11. The creel as defined in claim 6, wherein:
said rod portion having its end rigidly mounted is shorter than the other rod portion which is carried by said movable element.
12. The creel as defined in claim 1, wherein:
each of said holders contains a substantially flat body member disposed essentially perpendicular to said center plane and containing recesses defining said guides.
13. The creel as defined in claim 1, wherein:
each of said guides is formed by a substantially U-shaped recess provided at a substantially flat body member.
14. The creel as defined in claim 1, wherein:
said guides are distributed about a center at an essentially uniform angular spacing from one another.

* * * * *

UNITED STATES PATENT AND TRADEMARK OFFICE

CERTIFICATE OF CORRECTION

PATENT NO. : 4,408,731

DATED : October 11, 1983

INVENTOR(S) : EDUARD SCHENKEL

It is certified that error appears in the above-identified patent and that said Letters Patent are hereby corrected as shown below:

Column 8, line 35, "or" should read --of--

Column 9, line 11, before "again", "work" should read --back--

Signed and Sealed this

*Twenty-fourth* Day of *July 1984*

[SEAL]

*Attest:*

GERALD J. MOSSINGHOFF

*Attesting Officer*

*Commissioner of Patents and Trademarks*